US005153963A

United States Patent [19]

Saxon et al.

[11] Patent Number: 5,153,963

[45] Date of Patent: Oct. 13, 1992

[54] TUBE CLEANING TOOL FOR REMOVAL OF HARD DEPOSITS

[75] Inventors: Gregory J. Saxon; Daniel C. Lyle, both of Oakmont, Pa.

[73] Assignee: Conco Systems Inc., Verona, Pa.

[21] Appl. No.: 710,681

[22] Filed: Jun. 5, 1991

[51] Int. Cl.[5] ..... B08B 9/04

[52] U.S. Cl. ..... 15/104.061; 15/3.51

[58] Field of Search ..... 15/104.05, 104.061, 15/104.063, 104.13, 104.16, 104.31, 3.5, 3.51

[56] References Cited

U.S. PATENT DOCUMENTS

| | | | |
|---|---|---|---|
| 1,278,453 | 9/1918 | Frank | 15/104.061 |
| 1,598,771 | 9/1926 | Gerhardt | 15/104.061 |
| 2,170,997 | 8/1939 | Griffin | 15/104.061 |
| 2,734,208 | 2/1956 | Griffin | 15/104.061 |
| 4,281,432 | 8/1981 | Saxon | 15/104.061 |
| 4,573,231 | 3/1986 | Stocksiefen et al. | 15/104.061 |

FOREIGN PATENT DOCUMENTS

| | | | |
|---|---|---|---|
| 433832 | 9/1926 | Fed. Rep. of Germany | 15/104.061 |

*Primary Examiner*—Edward L. Roberts

*Attorney, Agent, or Firm*—Armstrong & Kubovcik

[57] ABSTRACT

A tube cleaning tool for removal of hard deposits from the interior wall of a tube has a cylindrical body portion with an outer diameter, less than the inner diameter of the tube, a nose portion at one end and a tail portion at the other end, with a plurality of spaced freewheeling cutting wheels provided on the body portion which extend outwardly therefrom, the cutting wheels at least partially contained within the confines of the cylindrical body portion and rotatable about an axis transverse the longitudinal axis of the cylindrical body portion.

20 Claims, 2 Drawing Sheets

TUBE CLEANING TOOL FOR REMOVAL OF HARD DEPOSITS

FIELD OF THE INVENTION

The present invention relates to a tube cleaning tool for the removal of hard deposits from the interior wall of tubes such as condenser and heat exchanger tubes.

BACKGROUND OF THE INVENTION

It is known to use fluid driven projectiles or scrapers for the removal of mud, slime, metal oxides or other deposits from the interior wall of a condenser or similar tube. Such scrapers generally comprise one or more fixed blades, bristles, or wire pieces which extend outwardly from a projectile shaft. When the projectile shaft is inserted into a tube, the scraper elements contact the tube wall to clean the wall upon fluid propulsion of the scraper through the tube. Usually, the projectile shaft will have a flexible rear terminal section that is cylindrical in shape, with a diameter slightly greater than the inner diameter of the tube, with fluid pressure exerted on the rear terminal section to drive the scraper through the tube. The tube can thus be cleaned without the need for any attached and externally manipulated line or handles. Examples of such tube cleaning projectiles are described, for example, in U.S. Pat. No. 1,598,771; 2,170,997; 2,734,208 and 4,281,432.

While such tube cleaning projectiles are efficient in cleaning of deposits from the interior walls of tubes, certain deposits referred to as scale, containing calcium or silicon, are formed as hard coatings on the interior wall which are resistant to complete removal by such projectiles. Such hard deposits, if not removeable by the scrapers, because of difficulty in breaking up the hard deposit, are usually removed by an acid wash or are left on the wall, which results in inefficient heat transfer between the tube contents and the outer tube environment. A need thus exists for a device that will break up such hard deposits so that those deposits can be removed from the interior wall of the tube by existing scrapers.

It is an object of the present invention to provide a tube cleaning tool for loosening of hard deposits collected on an interior wall of a tube.

It is another object of the present invention to provide a method for the removal of hard deposits from the interior wall of a tube, such as a condenser tube.

SUMMARY OF THE INVENTION

A tube cleaning tool for loosening of hard deposits collected on an interior wall of a tube, using fluid propulsion of the tool, has a cylindrical body portion with an outer diameter less than the inner diameter of the tube, the cylindrical body portion having a nose portion at one end and a tail portion at the other end. A plurality of spaced freewheeling cutting wheels are provided on the body portion which extend radially outwardly therefrom, which cutting wheels are at least partially contained within the confines of the cylindrical body, with the cutting wheels rotatable about an axis that is transverse to the longitudinal axis of the cylindrical body portion.

At least three, and preferably four or more, cutting wheels are provided, each of which are rotatable about an axis that is perpendicular to the longitudinal axis of the cylindrical body portion, with a major portion of the cutting wheels contained within the confines of the cylindrical body portion.

In one embodiment, a first plurality of cutting wheels are provided adjacent the nose portion of the cylindrical body portion and a second plurality of spaced cutting wheels are provided adjacent the tail portion and offset from the cutting wheels of the first plurality thereof.

The cylindrical body portion may comprise a cylindrical member having a recess in one end which forms an encircling wall about the recess, with spaced slots formed in the encircling wall. The nose portion may be formed as a truncated cone having a base with a rearwardly extending tubular member thereon which has an outer diameter which cooperates with the inner diameter of the encircling wall of the recess of the cylindrical member, the rearwardly extending tubular member having channels therein which are aligned with the slots in the encircling wall of the cylindrical member when engaged therein, with the cutting wheels supported on a support ring on the tubular member and extending outwardly through the slots of the tubular member.

The nose portion and tail portion are secured to the cylindrical body portion preferably by a locking member passing through aligned bores in those members to lock those members together as a unit.

DESCRIPTION OF THE DRAWINGS

The invention will become more readily apparent from the following description of preferred embodiments thereof shown, by way of example only, in the accompanying drawings, wherein.

DETAILED DESCRIPTION

Figure 1:
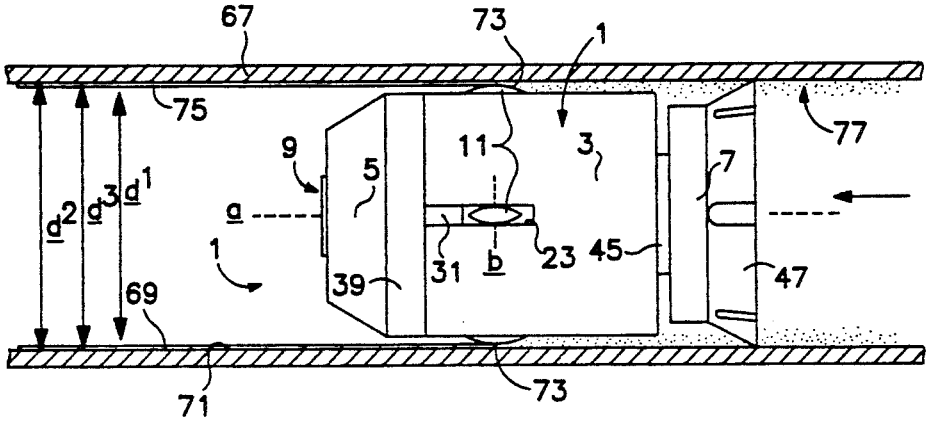
FIG. 1 in a side elevational view of an embodiment of the tube cleaning tool of the present invention in a tube being cleaned, the tube shown in cross-section.

One embodiment of the tube cleaning tool 1 of the present invention is illustrated in FIG. 1. The tool comprises a cylindrical body portion 3, having a longitudinal axis a, a nose portion 5, a tail portion 7 and a locking member 9, with a plurality of spaced, freewheeling cutting wheels provided in and extending radially outwardly from the cylindrical body portion. The cutting wheels 11 are at least partially contained within the confines of the cylindrical body and are rotatable about an axis that is transverse, and preferably perpendicular to, and fixed relative to the longitudinal axis a of the cylindrical body portion 3.

Figure 2:
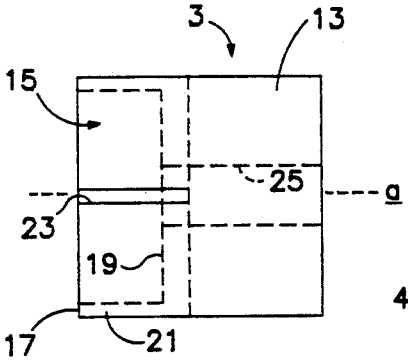
FIG. 2 is side elevational view of the cylindrical body portion of the tube cleaning tool of FIG. 1 prior to assembly of the tool.
Figure 3:
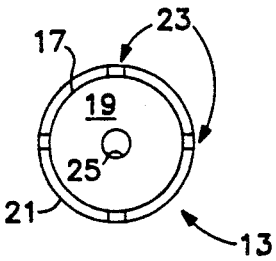
FIG. 3 is an end view of the cylindrical body portion of FIG. 2 looking towards the recess thereof.

The cylindrical body portion 3, as illustrated in FIGS. 2 and 3, is preferably formed as a cylindrical member 13 having a recess 15 in one end 17 thereof which forms a floor 19 and an encircling wall 21 about the recess 15, with spaced slots 23 formed in the encircling wall 21 for positioning of the cutting wheels therein and at least partially within the confines of the cylindrical body portion 3. A first bore 25, is formed through the cylindrical member 13 along the longitudinal axis a thereof.

Figure 4:
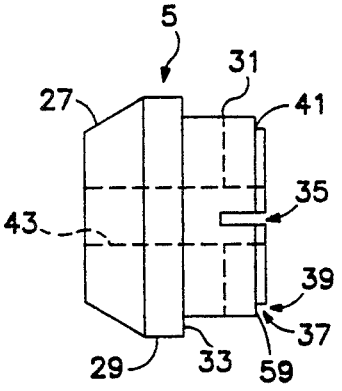
FIG. 4 is a side elevational view of the nose portion of the tube cleaning tool of FIG. 1 prior to assembly of the tool.
Figure 5:
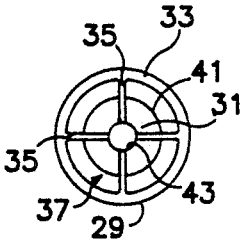
FIG. 5 is an view of the nose portion of FIG. 4 looking towards the base of the nose portion.

The nose portion 5, as illustrated in FIGS. 4 and 5, is preferably formed as a truncated cone 27, having a base 29 with a rearwardly extending tubular member 31 provided thereon. The rearwardly extending .tubular member 31 has an outer diameter less than the outer diameter of the base 29, forming a shoulder 33 therebetween the outer diameter of the rearwardly extending tubular member 31 cooperating with the inner diameter of the encircling wall 21 forming the recess 15 of the cylindrical member 13. Spaced channels 35 are provided in the rearwardly extending tubular member 31 of the nose portion 5 which align with the slots 23 in the encircling wall 21 of the cylindrical member 13 when the rearwardly extending tubular member 31 of the nose portion 5 is engaged in the recess 15 of the cylindrical member 13. The rearwardly extending tubular member 31 has a groove 37 therein at the end 39 opposite the base 29 of the truncated cone 27, which groove 37 forms a support surface 41. A second bore 43 is formed through the nose portion 5 coaxial with first bore 25 of the cylindrical member 13.

Figure 6:
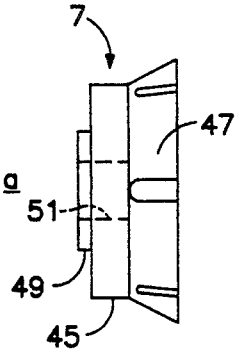
FIG. 6 is a side elevational view of the tail portion of the tube cleaning tool of FIG. 1 prior to assembly of the tool.

The tail portion 7, as illustrated in FIG. 6, is preferably formed as a circular member 45 having a rearwardly and outwardly extending flexible skirt 47 and a forwardly extending spacer member 49 for contact with the cylindrical member 13. A third bore 51 is formed through the tail portion 7, coaxial with the first bore 25 of the cylindrical member 13.

Figure 7:
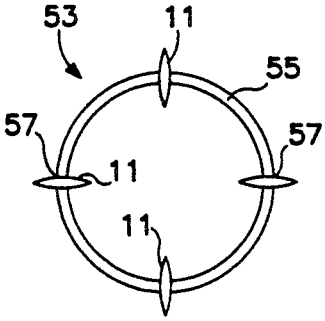
FIG. 7 is a front elevational view of a plurality of cutting wheels disposed on a support ring used in the tube cleaning tool of the present invention.

The cutting wheels 11 are supported such that a portion thereof extends outwardly from the cylindrical member 13 while at least a portion, and preferably a major portion of the cutting wheels 11 are contained within the confines of the cylindrical body portion 13. A support means 53 for supporting the freewheeling cutting wheels 11 in a fixed position relative to the longitudinal axis of the cylindrical body portion, as illustrated in FIG. 7, may comprise a support ring 55 which passes through central aperture 57 in the freewheeling cutting wheels 11, which support ring is disposed on the support surface 41 of the tubular member 31, with the support ring 55 disposed between the face 59 of the groove 37 in the rearwardly extending tubular member 31 and the floor 19 forming the recess 15 in the cylindrical member 13, with a portion of the freewheeling cutting wheels 11 disposed in the channels 35 in the rearwardly extending tubular member as well as the slots 23 in the cylindrical member 13, and with the remaining portion of the freewheeling cutting wheels 11 extending radially outwardly from the cylindrical body portion 3. At least three, and preferably four, cutting wheels are provided spaced about the circumference of the cylindrical body portion 3.

Figure 8:
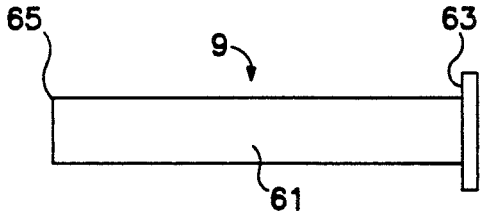
FIG. 8 is a side elevational view of a preferred locking member for use in the tube cleaning tool of the present invention.

The cylindrical body portion 3, nose portion 5 and tail portion 7 of the tube cleaning tool with the freewheeling cutting wheels 11 in place, are secured together as a unit. A preferred securement is by use of a locking member 9 in the form of a locking shaft 61 (FIG. 8), such as a rivet, having a flange 63 at one end. The locking shaft 61 is inserted through the second bore 43 of the nose portion 5, through the first bore 25 of the cylindrical member 13 and then through the third bore 51 of the tail portion 7, with the other end 65 of the locking shaft 61 peened or rolled over to contact the circular member 45 of the tail portion 7 and lock the nose portion 5, cylindrical body portion 3 and tail portion 7 together as a unit.

The tube cleaning tool 1 is sized such that the cylindrical body portion 3 has a diameter $d^1$ (FIG. 1) which is less than the inner diameter $d^2$ of a tube 67 which is to be cleaned and the thickness of the hard deposits 69 on the interior wall 71 of the tube 67. The freewheeling cutting wheels 11 extend radially outwardly from the cylindrical body portion 3 an amount such that at least the outer edges 73 of opposed cutting wheels are spaced apart a distance $d^3$, which is between the inner surface 75 of the hard deposits 69 and the interior wall 71 of the tube 67, so as to cut into the hard deposits 69 and break up the hard deposits 69 as the tube cleaning tool 1 is forced by fluid through the tube 67. The outwardly extending flexible skirt 47 of the tail portion is sized so as to be able to contact the interior wall 71 of the tube 67.

In accordance with the present method, the tube cleaning tool for loosening of hard deposits 69, such as calcium-containing or silicon-containing deposits, collected on an interior wall 71 of a tube 67, is inserted, nose portion first, into the tube 67 and a pressurized fluid, such as water, is directed against the outwardly extending flexible skirt 47, to drive the tube cleaning tool 1 through the tube 67 in the direction of the arrow shown in FIG. 1. As the tube cleaning tool is forced through the tube 67, the freewheeling cutting wheels rotate and cut into the hard deposits 69 to break up the hard deposits into pieces, illustrated as 77 in FIG. 1. While some of the pieces 77 of broken hard deposits 69 may be removed from the tube 67 by the outwardly extending flexible skirt 47, it is expected that, following passage of the tube cleaning tool 1 through the tube 67, and breakage of the hard deposits, passage of a second scraper tool, such as is available commercially, through the tube 67 will be required to remove the pieces 77. Such removal of the pieces 77 would be readily achieved since the coating of hard deposit 69 is no longer present. Removal of the pieces 77 would be effected as would removal of loose sludge or other pieces of material collected in the tube 67.

The cylindrical body portion 3, nose portion 5 and tail portion 7 may be formed from any material having sufficient strength and machineability, and are preferably nylon. The cutting wheels 11 may be of material of sufficent strength to cut through the hard deposits and retain a sharp edge, and may be formed, for example, from tungsten carbide.

Figure 9:
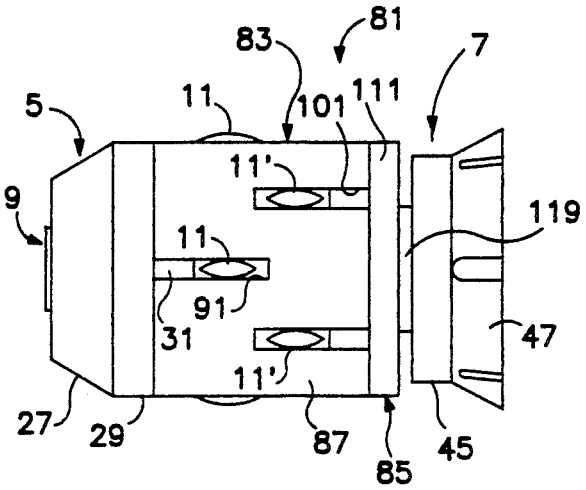
FIG. 9 is a side elevational view of another embodiment of the tube cleaning tool of the present invention.
Figure 10:
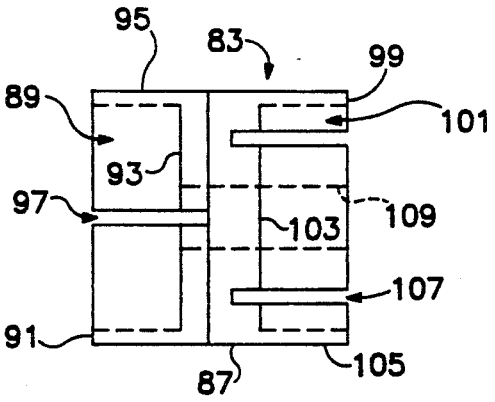
FIG. 10 is a side elevational view of the cylindrical body portion of the embodiment of the cleaning tool of FIG. 9 prior to assembly of the tool.
Figure 11:
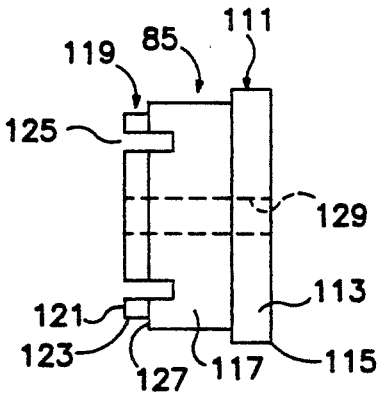
FIG. 11 is a side elevational view of a supplemental support member for use with the cylindrical body portion of the embodiment of the tube cleaning tool of FIG. 9 prior to assembly of the tool.

A further embodiment of the tube cleaning tool of the present invention is illustrated in FIGS. 9–11, wherein a tube cleaning tool 81 has a nose portion 5 and tail portion 7 as in the first embodiment illustrated in FIGS.

1-8, but wherein the cylindrical body portion 83 is modified to accept additional freewheeling cutting wheels 11', and a supplementary support member is provided for the additional freewheeling cutting wheels. The nose portion 5 and the tail portion 7 used in the embodiment of tube cleaning tool 81 are the same as that used in tube cleaning tool 1 and need not be described again, and have been illustrated hereinbefore in FIGS. 4, 5 and 7, as is the locking member 9. The cylindrical body portion 83 is modified however, and a supplemental support means 85 added to the tube cleaning tool. As is best shown in FIG. 10, the cylindrical body portion 83 is formed as a cylindrical member 87 having a first recess 89 in one end 91, the leading end, which forms a first floor 93 and first encircling wall 95 about the first recess 89. Spaced slots 97 are formed in the encircling first wall 95 for positioning of cutting wheels 11 therein, as have been hereinbefore described relative to the embodiment of FIGS. 1-8, with a support ring 53 carried by the support surface 41 on the rearwardly extending tubular member 31. The freewheeling cutting wheels 11 are situated in channels 35 of the nose portion 5 and the slots 97 in the cylindrical member 87. The other end 99, or trailing end, of the cylindrical member 87 has a second recess 101 therein which forms a second floor 103 and a second encircling wall 105 about the second recess 101, with spaced further slots 107 formed in the second encircling wall 105 for positioning of further cutting wheels 11' therein and at least partially within the confines of the cylindrical member 87 along the longitudinal axis thereof The further slots 107 are preferably offset from the slots 97, about the circumference of the cylindrical member 87. A bore 109 is provided through the cylindrical member 87 along the longitudinal axis thereof.

The supplemental support means 85 is illustrated in FIG. 11 as a plug which has an outwardly extending flange 113 at one end 115, a reduced diameter portion 117 having an outer diameter that cooperates with the inner diameter of the second recess 101 of the cylindrical member 87. A groove 119 is provided at the other end 121 of the plug 111, which groove forms a second support surface 123. Spaced channels 125 are provided in the reduced diameter portion 117 of the plug 111, which align with the further slots 107 in the second encircling wall 105 of the cylindrical member 87. The further cutting wheels 11' may be supported on a support ring 55 through central apertures in the further cutting wheels 11'. The support ring is then disposed on the second support surface 123 of the plug 85 between the face 127 of the groove 119 in the plug 85 and the second floor 103 forming the second recess 101 in the cylindrical member 87. A portion of the freewheeling further cutting wheels 11' are disposed in the channels 125 in the plug 85 as well as in the further slots 107 in the cylindrical member 87, with the remaining portion of the freewheeling cutting wheels 11' extending radially outwardly from the cylindrical body portion 83, as do the cutting wheels 11 of the embodiment illustrated in FIGS. 1-8. A bore 129 is provided through the plug 85 which is coaxial with the bore 109 through the cylindrical member 87. The embodiment of FIGS. 9-11 is assembled as a unit by passage of a locking member 9 through nose portion 5, cylindrical member 87, plug 85 and tail member 7 and those various members locked together as a unit thereby.

What is claimed is:

1. A tube cleaning tool for loosening of hard deposits collected on an interior wall of a tube comprising:

a cylindrical body portion having an outer diameter, less than the inner diameter of said tube, and a longitudinal axis;

a nose portion on one end of said cylindrical body portion;

a tail portion on the other end of said cylindrical body portion; and a plurality of spaced freewheeling cutting wheels provided in and extending radially outwardly from said cylindrical body portion, said cutting wheels being at least partially contained within the confines of said cylindrical body, each said cutting wheel rotatable about an axis that is transverse to the longitudinal axis of said cylindrical body portion and in a fixed position relative to said longitudinal axis.

2. A tube cleaning tool as defined in claim 1, wherein each said cutting wheel is rotatable about an axis that is perpendicular to the longitudinal axis of said cylindrical body portion.

3. A tube cleaning tool as defined in claim 1, wherein at least three of said cutting wheels are provided on said cylindrical body portion.

4. A tube cleaning tool as defined in claim wherein a major portion of said cutting wheels are contained within the confines of said cylindrical body.

5. A tube cleaning tool as defined in claim 1, wherein said nose portion is formed as a truncated cone.

6. A tube cleaning tool as defined in claim wherein said tail portion has thereon an outwardly and rearwardly extending flexible skirt.

7. A tube cleaning tool as defined in claim 1, wherein said cylindrical body portion comprises a cylindrical member having a recess in one end thereof forming an encircling wall about said recess and wherein spaced slots are formed in said encircling wall for positioning of said cutting wheels therein and at least partially within the confines of said cylindrical body.

8. A tube cleaning tool as defined in claim 7, wherein s id nose portion is formed as a truncated cone having a base with a rearwardly extending tubular member provided thereon, said rearwardly extending tubular member having an outer diameter which cooperates with an inner diameter of said encircling wall of the recess of said cylindrical member and channels in said tubular member which align with the slots in said encircling wall, and wherein said tubular member is engaged in the recess of said cylindrical member.

9. A tube cleaning tool as defined in claim 8, wherein said tubular member has a groove therein at the end opposite the base of said truncated cone, said groove forming a support surface.

10. A tube cleaning tool as defined in claim 9, wherein said freewheeling cutting wheels are rotatably supported on a support ring, with said support ring disposed on said support surface of said tubular member and a portion of said cutting wheels extend outwardly through the slots of said encircling wall of said cylindrical member.

11. A tube cleaning tool as defined in claim 10, wherein said cylindrical body portion has a first bore therethrough, said nose portion has a second bore therethrough and said tail portion has a third bore therethrough, said first, second and third bores aligned along the longitudinal axis of said cylindrical body member, and wherein a locking member is provided through said bores to secure said cylindrical body portion, nose portion and tail portion together as an unit.

12. A tube cleaning tool as defined in claim 11, wherein said locking member has a flange at one end and a crimped portion at the other end.

13. A tube cleaning tool as defined in claim wherein a first plurality of said spaced cutting wheels are, provided adjacent said nose portion of said cylindrical body and a second plurality of spaced cutting wheels are provided adjacent said tail portion of said cylindrical body.

14. A tube cleaning tool as defined in claim 13, wherein said cylindrical body portion comprises a cylindrical member having a first recess in one end thereof forming a first encircling wall about said first recess and wherein spaced slots are formed in said first encircling wall for positioning of said first plurality of cutting wheels therein at least partially within the confines of said cylindrical body, and a second recess in the other end thereof forming a second encircling wall about said second recess and wherein spaced further slots are formed in said second encircling wall for positioning of said second plurality of cutting wheels therein, offset from said first cutting wheels, at least partially within the confines of said cylindrical body.

15. A tube cleaning tool as defined in claim 14, wherein said nose portion is formed as a truncated cone having a base with a rearwardly extending tubular member provided thereon, said rearwardly extending tubular member having an outer diameter which cooperates with an inner diameter of said first encircling wall of the first recess of said cylindrical member and channels in said tubular member which align with the slots in said first encircling wall, said tubular member being engaged in the first recess of said cylindrical member, and a plug is provided having a reduced diameter portion having a outer diameter which cooperates with an inner diameter of said second encircling wall of the second recess of said cylindrical member and channels are provided in said plug which align with said further slots in said second encircling wall, said reduced diameter portion of said plug being engaged in the second recess of said cylindrical member.

16. A tube cleaning tool as defined in claim 15, wherein said tubular member has a groove therein at the end opposite the base of the truncated cone, said groove forming a support surface, said plug has a groove therein forming a support surface, said first plurality of freewheeling cutting wheels are rotatably supported on a support ring, with said support ring disposed on said support surface of said tubular member and a portion of said first plurality of cutting wheels extend outwardly through the slots of said first encircling wall of said cylindrical member, and said second plurality of freewheeling cutting wheels are rotatably supported on a support ring, with said support ring disposed on said support surface of said plug and a portion of said second plurality of cutting wheels extend outwardly through said further slots of said second encircling wall of said cylindrical member.

17. A tube cleaning tool for loosening of hard deposits collected o an interior wall of a tube comprising:

a cylindrical body portion, having an outer diameter less than the inner diameter of said tube and a longitudinal axis, comprising a cylindrical member having a recess in one end thereof forming an encircling wall about said recess and wherein spaced slots are formed in said encircling wall for positioning of cutting wheels therein and at least partially within the confines of said cylindrical body, a nose portion on one end of said cylindrical body portion, said nose portion formed as a truncated cone having a base with a rearwardly extending tubular member provided thereon, said rearwardly extending tubular member having an outer diameter which cooperates with an inner diameter of said encircling wall of the recess of said cylindrical member and channels in said tubular member which align with the slots in said encircling wall, said tubular member engaged in the recess of said cylindrical member;

a tail portion on the other end of said cylindrical body portion having an outwardly and rearwardly extending flexible skirt thereon; and a plurality of spaced freewheeling cutting wheels provided in and extending radially outwardly, through said spaced slots, from said cylindrical body portion, said cutting wheels being at least partially contained within the confines of said cylindrical body, each said cutting wheel rotatable about an axis that is transverse to the longitudinal axis of said cylindrical body portion.

18. A tube cleaning tool as defined in claim 17, wherein said tubular member has a groove therein at the end opposite the base of said truncated cone, said groove forming a support surface.

19. A tube cleaning tool as defined in claim 18, wherein said freewheeling cutting wheels are rotatably supported on a support ring, with said support ring disposed on said support surface of said tubular member and a portion of said cutting wheels extend outwardly through the slots of said encircling wall of said cylindrical member.

20. A tube cleaning tool as defined in claim 19, wherein said cylindrical body portion has a first bore therethrough, said nose portion has a second bore therethrough and said tail portion has a third bore therethrough, said first, second and third bores aligned along the longitudinal axis of said cylindrical body member, and wherein a locking member is provided through said bores to secure said cylindrical body portion, nose portion and tail portion together as a unit.

* * * * *

UNITED STATES PATENT AND TRADEMARK OFFICE

CERTIFICATE OF CORRECTION

PATENT NO. : 5,153,963

DATED : October 13, 1992

INVENTOR(S) : Gregory J. Saxon: Daniel C. Lyle

It is certified that error appears in the above-indentified patent and that said Letters Patent is hereby corrected as shown below:

Column 7, line 6, insert ---1,--- between "claim" and "wherein".

line 7, delete the comma.

Signed and Sealed this

Twelfth Day of October, 1993

*Attest:*

*Attesting Officer*

BRUCE LEHMAN

*Commissioner of Patents and Trademarks*